US010328440B2

(12) United States Patent
Nobili

(10) Patent No.: US 10,328,440 B2
(45) Date of Patent: Jun. 25, 2019

(54) SHOWERHEAD AND MEMBRANE THEREFOR

(71) Applicant: Fabrizio Nobili, San Vittore (CH)

(72) Inventor: Fabrizio Nobili, San Vittore (CH)

( * ) Notice: Subject to any disclaimer, the term of this patent is extended or adjusted under 35 U.S.C. 154(b) by 22 days.

(21) Appl. No.: 15/446,177

(22) Filed: Mar. 1, 2017

(65) Prior Publication Data

US 2018/0250690 A1 Sep. 6, 2018

(51) Int. Cl.
*B05B 1/18* (2006.01)

(52) U.S. Cl.
CPC ..... *B05B 1/185* (2013.01)

(58) Field of Classification Search
CPC ..... B05B 1/18; B05B 1/185; B05B 15/528
USPC ..... 239/106, 553, DIG. 12
See application file for complete search history.

(56) References Cited

U.S. PATENT DOCUMENTS 2,402,741 A * 6/1946 Draviner ..... B05B 1/185
239/533.14

* cited by examiner

*Primary Examiner* — Christopher S Kim
(74) *Attorney, Agent, or Firm* — Dorsey & Whitney LLP

(57) ABSTRACT

A showerhead is described, the showerhead comprising: a top plate, comprising at least one water inlet; a bottom plate, comprising a plurality of holes through which the water is delivered; a membrane, comprising a disc of predefined thickness and a plurality of nozzles extending perpendicularly from the disc and inserted inside the holes of the bottom plate. The showerhead is characterized in that the membrane comprises a peripheral portion with thickness greater than the thickness of the disk, suitable for defining a water flow passage from the inlet to the plurality of nozzles between the top plate and the disc, and in that the peripheral portion includes a flexible tongue extending into the water flow passage and forming a seal against the top plate.

15 Claims, 4 Drawing Sheets

SHOWERHEAD AND MEMBRANE THEREFOR

TECHNICAL FIELD

Embodiments of the present invention relate to a showerhead comprising a top plate comprising at least one water inlet, a bottom plate comprising a plurality of holes (5) through which the water is delivered, and a membrane between the top plate and the bottom plate. Embodiments of the present invention also relate to a membrane for a showerhead, comprising a disc of predefined thickness and a plurality of nozzles extending from the disc.

BACKGROUND

Showerheads having an inlet which can be connected to a hot and/or cold water supply pipe, and a plurality of nozzles for delivery of the water, for example with a spray jet, are known. The nozzles may be associated, in a predetermined arrangement and number, with a rectangular or circular shaped plate in turn fixed and sealed to another plate, intended to be supported in the centre of the shower tray, for example by means of the water supply pipe or another support structure. In some cases the showerhead is wall-mounted, for example supported by a column or a base from which it protrudes with a predefined inclination towards the shower tray, so as to deliver the water towards the user. Other means for fixing the showerhead are also known.

Some showerheads have large-size plates, for example with dimensions between 30 and 50 cm, and are particularly popular because, since they are able to contain a large number of nozzles, they are able to deliver a very large volume of water, thus providing the user with a pleasant sensation. The nozzles are applied to the bottom plate of the showerhead which is then welded or glued to the top plate, thus defining a path for the fluid from the inlet to the nozzles.

A known drawback of such showerheads consists in small leakages of water through tiny cracks which form between the top plate and the bottom plate following wear. It is known to provide a simple sealing gasket between the two plates, but this solution is normally unable to prevent the small leakages since the gasket loses its elasticity with time, for example following the sudden changes in temperature of the heated water. Basically, after being used many times, a small amount of water usually leaks from the side edge of the showerhead, this being a nuisance both from an aesthetic and a functional point of view.

The problem forming the basis of the present invention is that of devising a showerhead with an improved sealing action, i.e., which is able to eliminate all the small leakages, especially at the joint between the top plate and the bottom plate, also following prolonged use over time, overcoming all the limitations and drawbacks which hitherto affect the known showerheads.

SUMMARY

The basic idea of embodiments of the present invention is that of arranging a membrane between a top plate and a bottom plate of a showerhead, this membrane having a disc on which the nozzles for delivery of the water are mounted and a peripheral portion provided with a sealing tongue which forms a seal against the top plate.

The disc is circular. However it is quite possible for the disc to have a different form, for example it may be square shaped.

The tongue extends upwards from the perimetral edge of the disc.

The tongue forms together with the disc an acute angle, which is preferably rounded.

The tongue extends from the edge of the disc and the tip of the tongue is closer to the centre of the disc than the base of the tongue.

Preferably, the tip of the tongue is also rounded. In one embodiment only the portion of the tip intended to remain in contact with the water is rounded. Even more preferably, this rounded portion of the tip is convex. The rounded acute angle is preferably concave. The tongue, extending upwards from the disc forms a collar for retaining the water. Said collar also defines a water flow passage between an inlet of the showerhead and a plurality of nozzles in the disc.

Preferably the tongue is tapered. The tip of the tongue has a thickness which is smaller than a thickness of the base. When the parts are assembled, a first surface of the tongue—called belly—is designed to come into contact with the water and a second surface of the tongue—called back—makes contact with the top plate of the showerhead, the plate making pressing contact against the back, flattening it, and lowering the tip of the tongue relative to its rest position, when the parts are not assembled (membrane not inserted between the top plate and the bottom plate).

Owing to such an arrangement of the tongue the water sealing effect may be increased significantly. In fact, the water present inside the passage exerts a pressure on the belly of the tongue which is all the greater the greater the incoming flow. In the case of a tapered tongue, the distal part closer to the tip undergoes a greater deformation than the part closer to the base and consequently is pushed with a greater force against the top plate, adhering perfectly thereto. The tip of the tongue is therefore nearly coplanar with the bottom surface of the top plate and the belly of the tongue acts as a collar or pocket for retaining the water.

On the basis of this proposed solution, the aforementioned technical problem is solved by a showerhead comprising: a top plate, comprising at least one water inlet, a bottom plate, comprising a plurality of holes through which the water is delivered, a membrane, comprising a disc of predefined thickness and a plurality of nozzles extending, preferably perpendicularly, from the disc and inserted inside the holes of the bottom plate, and characterized in that the membrane comprises a peripheral portion with a thickness greater than the thickness of the disc, suitable for defining a water flow passage from the inlet to the plurality of nozzles, between the top plate and the disc, and in that the peripheral portion includes a flexible tongue extending into the water flow passage and forming a seal against the top plate.

Preferably, the tongue comprises a tip making contact with the top plate and a first surface between the tip and the disc, suitable for remaining in contact with the water, during delivery, so as to compress the tip against the top plate.

According to one aspect of the invention, the peripheral portion comprises a flat surface and the tongue comprises a second surface between the tip and the flat surface of the peripheral portion, suitable for remaining at least partly in contact with the top plate of the showerhead, exerting thereon a pressure which is all the greater the greater the incoming water flow.

Preferably, the first surface of the tongue comprises a curved portion opposite the disc. In one embodiment, the curved portion of the first surface of the tongue is concave, and the first surface further comprises a second convex curved portion at the tip of the tongue.

According to another aspect of the invention, the disc is formed as one piece with the nozzles and with the peripheral portion. In one embodiment, the disc is made of silicone or rubber.

Preferably, the tongue is a tapered annular portion, even more preferably with a triangular section, of the peripheral portion.

According to a further aspect of the invention, the showerhead comprises a metal spacer, preferably made of stainless steel, between the top plate and the bottom plate, situated around the disc and having a thickness greater than the thickness of the disc, the thickness of the spacer preferably corresponding to the thickness of the peripheral portion opposite the flat surface. The top plate is welded to the bottom plate or otherwise sealed, for example with glue. The plates are for example made of metal, preferably stainless steel.

Preferably, the peripheral portion of the membrane is laterally in contact with the spacer.

According to yet another aspect of the invention, a bottom surface of the disc of the membrane is in contact with the bottom plate. The top plate, instead, makes pressing contact with the tongue and deforms it.

The aforementioned technical problem is also solved by a membrane for a showerhead, comprising a disc of predefined thickness and a plurality of nozzles extending (perpendicularly) from the disc, characterized in that it comprises a peripheral portion with a thickness greater than the thickness of the disc, suitable for defining a water flow passage from an inlet of the showerhead to the plurality of nozzles between a top plate of the showerhead and the disc, and in that the peripheral portion includes a flexible tongue extending radially from the peripheral portion inwards and upwards.

Preferably, the tongue has a second inclined surface or back, a distance (×1) between a base of the second surface and the disc is less than a distance (×2) between a tip of the tongue and the disc, and an annular segment, having a thickness less than the thickness of the peripheral portion opposite the flat surface, is provided between the flat surface and the second surface of the tongue.

Further characteristic features and advantages of the showerhead and the associated membrane according to the present invention will become clear from an example of embodiment thereof provided hereinbelow with reference to the attached drawings, solely by way of a non-limiting example.

DETAILED DESCRIPTION

Figure 1:
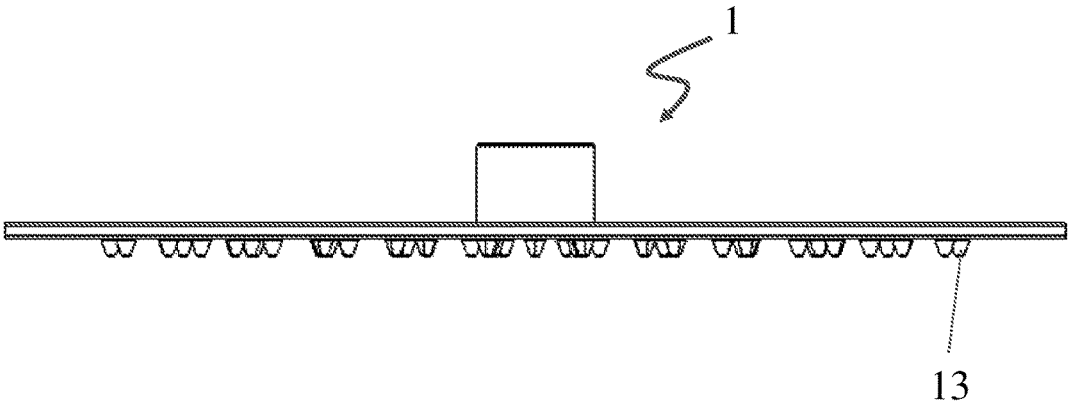
FIG. 1 shows a side view of the showerhead according to an embodiment of the present invention.
Figure 2:
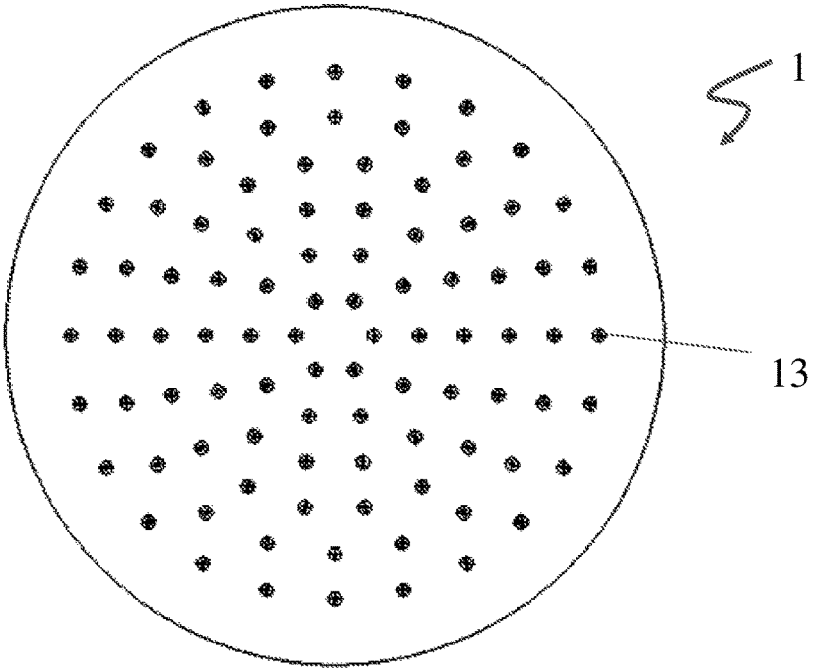
FIG. 2 is a front view, from below, of the showerhead according to FIG. 1.
Figure 3:
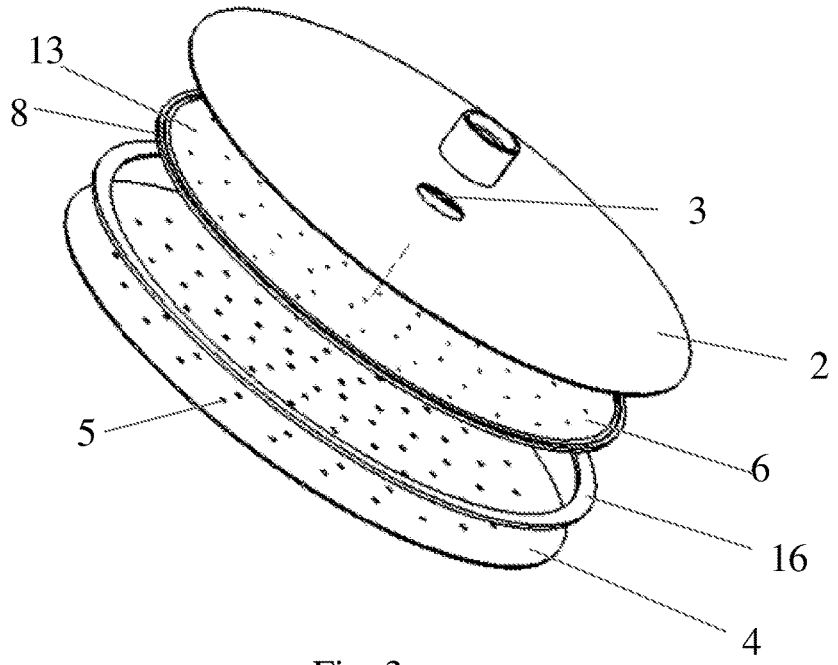
FIG. 3 is a perspective view, with parts separated, of the showerhead according to FIG. 1.

With reference to the attached figures a showerhead according to an embodiment of the present invention is schematically shown and indicated by the reference number 1. The showerhead has an inlet 3 (see FIG. 3) which can be connected to a hot and/or cold water supply pipe (not shown), and a plurality of nozzles 13 (FIGS. 1 and 2) for delivery of the water, for example with a spray jet. The nozzles are provided in a predetermined arrangement and number.

The showerhead may be rectangular or circular or square shaped, preferably with rounded edges, and is intended to be supported in the centre of the shower tray or in another position of the shower compartment, for example by means of the water supply pipe and or other support structure, such as a column or a base or a rod from which it extends with a predefined inclination towards the shower tray, so as to deliver the water towards the user. The size of the showerhead may be, for example, between 20 and 50 cm, so as to deliver the water in a diffused manner, resulting in a pleasing sensation for the user.

The inlet 3 is defined in a top portion or in a top plate 2 of the showerhead, for example in a plate 2 having a central hole associated with a threaded union to which a threaded portion of the water supply pipe is connected.

A bottom portion of the showerhead or bottom plate 4 comprises a plurality of holes 5 (FIG. 3) through which the water is delivered. Without limiting the scope of protection of the present invention, the top plate 3 and the bottom plate 4 are made of metal, preferably stainless steel, with a thickness ranging between a few millimeters and several centimeters, and the inlet 3 and the holes 5 are through-holes in the respective plate. The geometrical distribution of the holes 5 corresponds to the geometric distribution of the nozzles 13, as will become clear from the description below.

According to an embodiment of the present invention the plate 3 and the plate 4 have a constant thickness, i.e. without reliefs or peripheral collars. A spacer 16 (FIG. 4) which defines a water flow passage from the inlet to the nozzles is arranged between them. The plates are for example welded together, along the peripheral edge. Obviously it is quite possible, while remaining within the scope of protection of the invention, that at least one of the two plates is provided with a peripheral relief along which the other plate is fixed, for example welded, glued or otherwise sealed.

Figure 5:
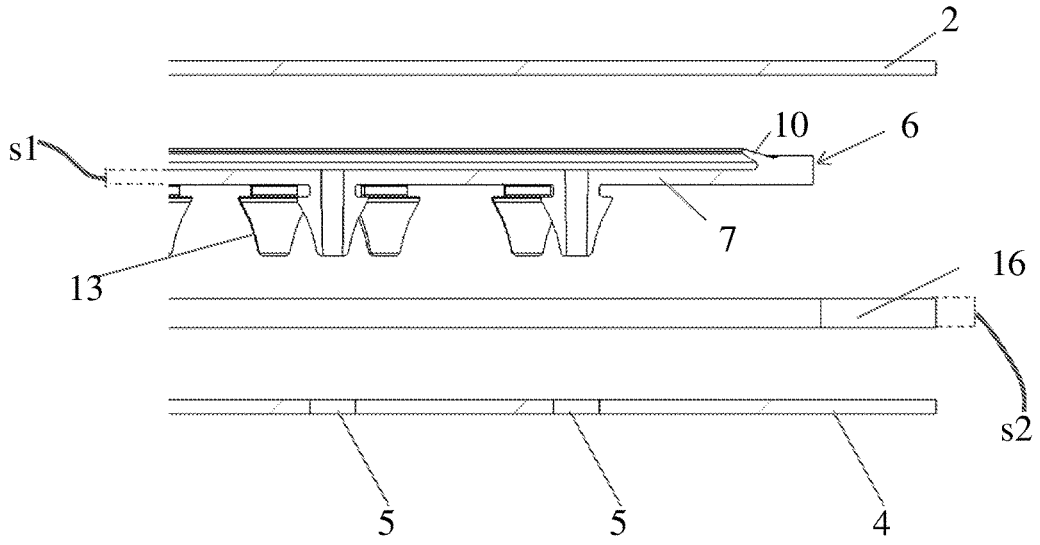
FIG. 5 is a laterally sectioned view, with parts separated, of the detail of FIG. 4.
Figure 6:
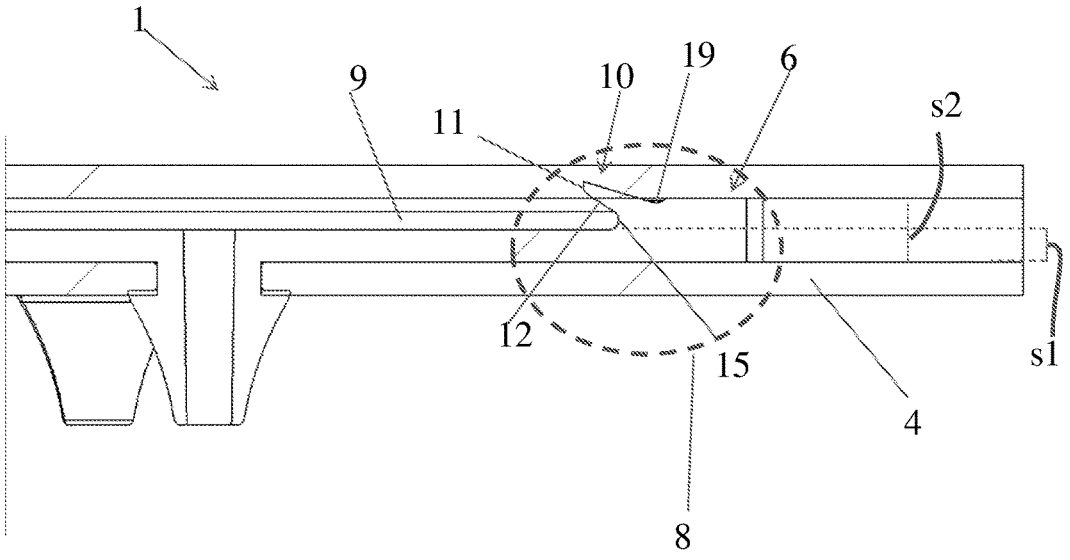
FIG. 6 is a laterally sectioned view, with parts assembled, of the detail of FIG. 4.
Figure 8:
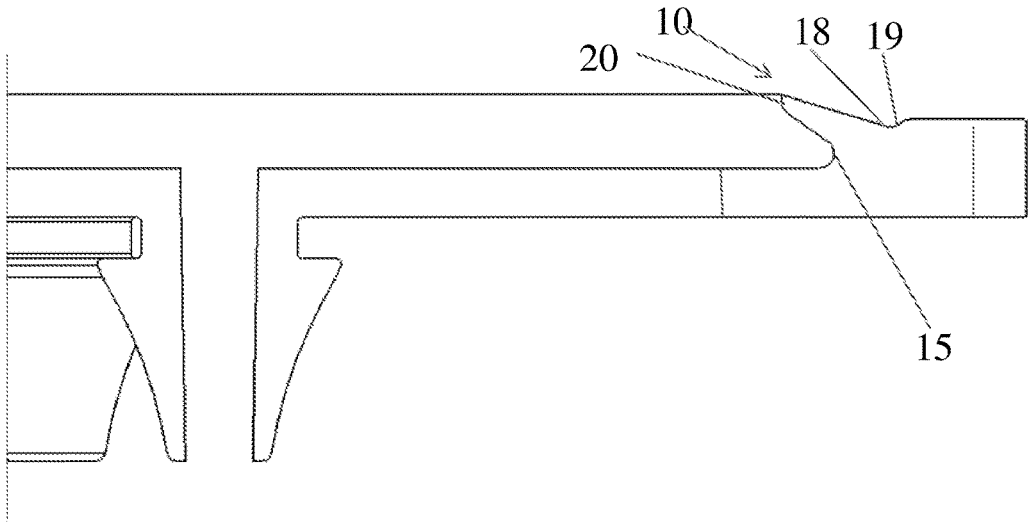
FIG. 8 shows a laterally sectioned view of a detail of a membrane of the showerhead according to an embodiment of the present invention.
Figure 7:
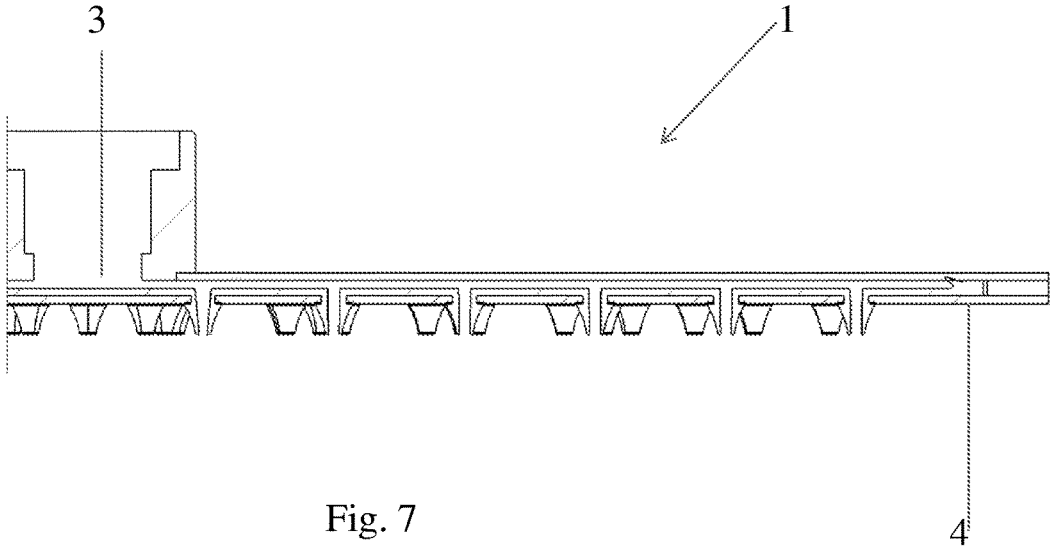
FIG. 7 is a laterally sectioned view, with parts assembled, of another detail of the showerhead according to FIG. 1.

The nozzles 13 are formed in a membrane 6 comprising a disc 7 of predefined thickness s1 from which the nozzles extend for example perpendicularly relative to the disc 7, as shown in FIGS. 5 and 6, and are inserted inside the holes 5 of the bottom plate 4. The nozzles have, for example a mushroom shape, with an annular section having a smaller diameter than that of the head, the smaller diameter being substantially the same as the diameter of the holes 5 of the bottom plate 4. At least the head portion of the nozzles is flexible and is inserted with force through the holes 5 so that the head of the nozzles emerges from a side of the bottom plate 4 opposite to a side with which the disc 7 remains in contact. The annular section of the nozzles instead remains within the thickness of the holes 5, which is preferably equal to the length of the annular section. According to an embodiment of the present invention, the membrane 6 comprises a peripheral portion 8 with thickness s2 greater than the thickness s1 of the disk 7, suitable for defining a water flow passage 9 from the inlet 3 to the plurality of nozzles 13, between the top plate 2 and the disc 7, and the peripheral portion 8 includes a flexible tongue 10 extending into the water flow passage (9) and forming a seal against the top plate (2).

Figure 4:
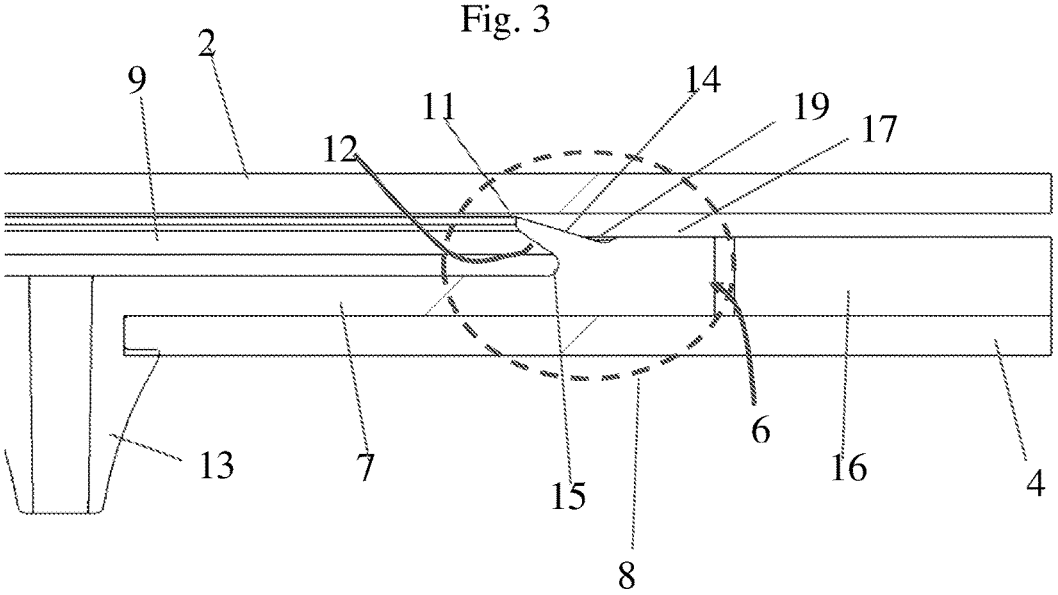
FIG. 4 is a laterally sectioned view, with parts partially separated, of a detail of the showerhead according to FIG. 1.

The peripheral portion 8 is for example shown encircled in FIGS. 4 and 6. In this example of embodiment, the portion 8 is situated alongside the spacer 16, in particular without coming into contact with it. However, as already mentioned, the spacer 16 may be replaced by a collar in one or both the plates 3 and 5, or may be removed, in which case the space between the discs is filled by a sealant or by a weld. Similarly, the spacer 16, the weld or the sealant may come into contact with a side edge of the peripheral portion 8.

A bottom part of the peripheral portion 8 is coplanar with the bottom surface of the disc 7 and substantially forms the extension thereof as far as the side of the side edge of the peripheral portion, which forms the side edge of the membrane 6. A top part of the peripheral portion 8, terminating on the side edge, is parallel to the substantially flat bottom part.

The tongue 10 is formed at a predefined distance from the side edge of the peripheral portion 8. When the parts are separated, i.e., when the membrane 6 is not yet enclosed between the bottom plate and the top plate, the tongue extends upwards with a predefined inclination from the top part of the peripheral portion 8.

The tongue 10, for example, has a length (viewed in the cross-section of FIG. 4) ranging between 2 mm and 1 cm, preferably between 2 mm and 3 mm. The tip 11 of the tongue for example extends upwards by an amount between 2 mm and 1 cm, preferably between 2 mm and 3 mm, when the parts are separated. When the parts are assembled, the top plate makes pressing contact with the top surface of the tongue, causing it to be lowered towards the disc, without coming into contact therewith. Preferably, the tongue is not lowered beyond the level of the top part of the peripheral portion 8.

In particular the tongue 10 comprises a tip 11 in contact with the top plate and a first surface 12 (bottom surface of the tongue) between the tip 11 and the disc 7, suitable for remaining in contact with the water, during delivery, so as to compress the tip 11 against the top plate 2.

The pressure of the water inside the fluid passage 9 exerts advantageously a pressure on the first surface 12 of the tongue which presses the tongue towards the top plate of the showerhead, which in turn pushes the tongue downwards, the tongue, making pressing contact with its top surface, therefore providing a particularly effective sealing action. In other words the tongue is sandwiched between the top plate and water flowing inside the passage 9, the water exerting a pressure on the tongue which is all the greater the greater the amount of water entering the showerhead. Consequently, even when the user opens up the water supply fully, the tongue 10 forms a perfect seal between the plates and avoids any leakages.

The peripheral portion 8 comprises the flat surface 17 (also called the top part of the peripheral portion in the preceding description) and the tongue 10 comprises a second surface 14 (also called top portion of the tongue) between the tip 11 and the flat surface 17 of the peripheral portion 8, designed to remain at least partly in contact with the top plate 2 of the showerhead, exerting thereon a pressure which is all the greater the greater the amount of the incoming water flow.

According to one aspect of the present invention, the first surface 12 of the tongue comprises a curved portion 15 opposite the disc 7. The curved portion forms a pocket where the fluid converges together with the peripheral edge of the membrane 6, i.e., at a base of the peripheral portion 8 facing the centre of the showerhead. Advantageously, such a pocket-like form produces a swirling flow which has the effect of compressing the tongue from the bottom upwards, further increasing the sealing action on the top plate 2.

Preferably, the curved portion 15 of the first surface 12 of the tongue 10 is concave, and the surface 12 further comprises a second convex curved portion 20 at the tip 11 of the tongue 10. Such a curvature of the second portion 20 ensures an improved sealing action of the tongue at the tip, since it prevents even small quantities of water from being able to reach the top surface 14 of the tongue and seep towards the peripheral edge of the showerhead.

In another preferred embodiment, the tongue 10 is a tapered annular portion, preferably with a triangular section, of said peripheral portion 8. The tongue becomes thinner towards the tip, thus having a greater deformability and reacting promptly to the water pressure.

According to a preferred embodiment of the present invention, the disc 7 is formed as one piece with the nozzles 13 and with the peripheral portion 8. As mentioned, assembly is performed by inserting the nozzles 13 inside the holes 5 of the bottom plate, optionally arranging the spacer 16 in position, and then positioning and sealing the top plate.

According to a method of applying the membrane developed by the Applicant, a sucker system is used to join together the bottom plate and membrane. A machine provided with a support surface for the bottom plate draws air through the holes 5, sucking down the membrane 6, and in particular the head of the nozzles 13 through the holes 5, said membrane having been previously positioned on top of the plate 4.

The disc 7 is for example made of silicone or rubber. The membrane and/or the nozzles may also be made of silicone or rubber. Preferably, the disc, the membrane and the nozzles are extruded or co-extruded together. The disc, the membrane and the nozzles are formed as one piece.

The spacer 16 is for example made of metal, preferably stainless steel, and has a thickness s2 greater than the thickness of the disc 7, preferably corresponding to the thickness of the peripheral portion 8 opposite the flat surface 17.

Advantageously, the membrane for a showerhead 1 has a particularly effective sealing action even following prolonged use over time. In an embodiment, the membrane, may also comprise a disc 7 of predefined thickness s1 and a plurality of nozzles 13 extending (preferably perpendicularly) from the disc 7.

The membrane has a peripheral portion 8 with thickness s2 greater than the thickness of the disc 7, suitable for defining a water flow passage 9 from an inlet 3 of the showerhead to the plurality of nozzles 13 between a top plate 2 of the showerhead and the disc 7, with the peripheral portion 8 having a flexible tongue 10 extending radially from the peripheral portion 8 inwards and upwards.

The membrane may therefore be formed by a first annular segment comprising the peripheral square part of the peripheral portion 8, namely the side edge and the flat top and bottom surfaces; a second annular segment radially closer to the centre of the membrane and comprising the tongue which extends from the first annular segment at a predefined angle upwards; a third segment formed by disc and by the nozzles at the base of the square peripheral portion.

A second surface 14 of the tongue 10 is inclined and a distance x1 exists between a base 18 of the second surface 14 of the tongue and the disc 7, this distance x1 being less than a distance x2 between a tip 11 of the tongue 10 and the disc 7.

An annular segment 19, having a thickness smaller than the thickness of the peripheral portion 8 opposite the flat surface, is provided between the flat surface 17 and the second surface 14 of the tongue 10.

According to an embodiment of the present invention, the membrane 6 comprises a second flexible tongue, suitable for ensuring a perfect sealing action, even in the event of failure of the (first) flexible tongue, for example due to manufacturing defects or incorrect operation. The second flexible tongue may be made of the same material as the first flexible tongue, and preferably formed as one piece with the membrane.

In one embodiment, the second flexible tongue is situated between said first flexible tongue 10 and an end part of the peripheral portion 8, i.e., the part which forms the edge of the membrane 6. For example, the second flexible tongue has a base on the flat surface 17 of the peripheral portion 8 and extends from the base towards the first flexible tongue. Preferably, the tip of the second flexible tongue is situated close to the second surface 14 of the first flexible tongue or is in contact therewith. The base of the second flexible tongue is instead situated at a predefined distance, for example 2 mm, from the base of the first flexible tongue, i.e., from the annular segment 19.

The second flexible tongue has a back directed towards the outside of the membrane and a belly directed towards the first flexible tongue. When the parts are assembled, the back is compressed by the top plate of the showerhead and forms a seal against it.

According to an embodiment, the second flexible tongue, folded onto the first flexible tongue, forms an air pocket. The air pocket is intended to collect any leaking fluid, preventing it from flowing towards the edge of the membrane 6.

The invention claimed is:

1. A showerhead, comprising:

a top plate including at least one water inlet;

a bottom plate including a plurality of holes through which the water is delivered;

a membrane including a disc of a predefined thickness; and a plurality of nozzles extending from the disc and inserted inside the holes of the bottom plate;

wherein:

the membrane includes a peripheral portion with a thickness greater than the predefined thickness of the disc suitable for defining a water flow passage from the inlet to the plurality of nozzles between the top plate and the disc;

the peripheral portion includes a flexible tongue extending into the water flow passage and forming a seal against the top plate;

the flexible tongue includes a tip in contact with the top plate, and a first surface between the tip and the disc configured to remain in contact with the water, during delivery, to compress the tip against the top plate;

the first surface of the tongue includes a curved portion connected to the disc;

the curved portion of the first surface of the tongue is concave; and the first surface includes a second convex curved portion at the tip of the tongue.

2. The showerhead according to claim 1, wherein the peripheral portion includes a flat surface, and the tongue includes a second surface between the tip and the flat surface of the peripheral portion suitable for remaining at least partly in contact with the top plate of the showerhead.

3. The showerhead according to claim 1, wherein the disc is formed as one piece with the plurality of nozzles and with the peripheral portion.

4. The showerhead according to claim 1, wherein the disc is made of silicone or rubber.

5. The showerhead according to claim 1, wherein the tongue is a tapered annular portion of the peripheral portion.

6. The showerhead according to claim 5, wherein tapered annular portion of the tongue includes a triangular section.

7. The showerhead according to claim 2, further comprising a metal spacer between the top plate and the bottom plate, the metal spacer situated around the disc and having a thickness greater than the predefined thickness of the disc.

8. The showerhead according to claim 7, wherein the metal spacer is made of stainless steel.

9. The showerhead according to claim 7, wherein the thickness of the metal spacer corresponds to the thickness of the peripheral portion.

10. The showerhead according to claim 7, wherein the peripheral portion is laterally in contact with the metal spacer.

11. The showerhead according to claim 1, wherein the disc includes a bottom surface in contact with the bottom plate.

12. The showerhead according to claim 1, wherein the top plate and the bottom plate are made of metal that is welded together.

13. The showerhead according to claim 12, wherein the metal of the top plate and the bottom plate includes stainless steel.

14. A membrane for a showerhead, the membrane comprising:

a disc of predefined thickness; and a plurality of nozzles extending perpendicularly from the disc;

a peripheral portion with a thickness greater than the thickness of the disc, suitable for defining a water flow passage from an inlet of the showerhead to the plurality of nozzles between a top plate of the showerhead and the disc;

wherein:

the peripheral portion includes a flexible tongue extending radially from the peripheral portion inwards and upwards;

the flexible tongue includes a tip, and a first surface between the tip and the disc;

the first surface of the tongue includes a curved portion connected to the disc;

the curved portion of the first surface of the tongue is concave; and the first surface includes a second convex curved portion at the tip of the tongue.

15. The membrane according to claim 14, further comprising a flat surface on the peripheral portion, wherein:

the flexible tongue includes a second surface inclined, a distance between a base of the second surface and the disc is less than a distance between a tip of the tongue and the disc; and the membrane further includes an annular segment, having a thickness less than the thickness of the peripheral portion, the annular segment arranged between the flat surface and the second surface of the tongue.

* * * * *